US011002056B2

(12) United States Patent
Demirtas et al.

(10) Patent No.: US 11,002,056 B2
(45) Date of Patent: May 11, 2021

(54) CABLE PULLEY FASTENER AND METHOD OF FASTENING A CABLE PULLEY FOR A WINDOW LIFTER OF A VEHICLE

(71) Applicant: INTEVA PRODUCTS, LLC, Troy, MI (US)

(72) Inventors: Ecevit Demirtas, Braunschweig (DE); Gabriel Hazon, Ouzouer sur Loire (FR); Stephane Hemond, Les Bordes (FR); Jean-Louis Robalo, Varennes Changy (FR); Eric Simonneau, Vienne en Val (FR)

(73) Assignee: INTEVA PRODUCTS, LLC, Troy, MI (US)

( * ) Notice: Subject to any disclaimer, the term of this patent is extended or adjusted under 35 U.S.C. 154(b) by 222 days.

(21) Appl. No.: 16/013,457

(22) Filed: Jun. 20, 2018

(65) Prior Publication Data

US 2018/0371816 A1 Dec. 27, 2018

(30) Foreign Application Priority Data

Jun. 21, 2017 (DE) ..... 102017113682.7

(51) Int. Cl.
*E05F 11/48* (2006.01)
*E05F 15/689* (2015.01)

(52) U.S. Cl.
CPC ..... *E05F 11/483* (2013.01); *E05F 15/689* (2015.01); *E05Y 2201/668* (2013.01); *E05Y 2201/706* (2013.01); *E05Y 2900/55* (2013.01)

(58) Field of Classification Search
CPC ..... F16H 7/18; F16H 7/22; F16H 7/20; F16H 2007/0865; E05F 11/483; E05F 15/689; E05F 15/627; E05F 15/63; E05Y 2900/55; E05Y 2201/668; F16C 13/006; F16C 35/073; F16C 2361/63; F16C 41/04; F16B 41/002; F16B 41/005
USPC ..... 49/352, 356; 296/146.11, 56; 474/166, 474/168, 170, 184; 29/525.01
See application file for complete search history.

(56) References Cited

U.S. PATENT DOCUMENTS 5,275,577 A * 1/1994 Hildebrandt ..... F16D 1/0858 474/174
5,564,231 A * 10/1996 Tajima ..... E05F 15/697 49/352
6,293,320 B1 * 9/2001 McGregor, II ..... B23C 1/00 142/1
6,607,339 B1 * 8/2003 Mangapora ..... E05F 11/483 411/107
6,746,285 B2 * 6/2004 Delcourt ..... H01R 4/30 439/766
7,056,161 B2 * 6/2006 Delcourt ..... H01R 4/30 174/51
9,028,352 B2 * 5/2015 Wilson ..... F16C 13/006 29/525.01
10,309,140 B2 * 6/2019 Imaoka ..... E05F 11/48
2003/0140562 A1 * 7/2003 Staser ..... E05F 11/382 49/352

(Continued)

*Primary Examiner* — Chi Q Nguyen
(74) *Attorney, Agent, or Firm* — Cantor Colburn LLP

(57) ABSTRACT

A pulley stud for a window regulator is provided. The pulley stud having: an upper head portion; a shaft portion; a first mounting portion; and a second mounting portion, wherein the first mounting portion has an anti-rotation portion located on a portion of the periphery of the first mounting portion.

17 Claims, 5 Drawing Sheets

(56) References Cited

U.S. PATENT DOCUMENTS

| | | | | |
|---|---|---|---|---|
| 2004/0194390 | A1* | 10/2004 | Ishikawa | B60J 10/74 49/352 |
| 2004/0255410 | A1* | 12/2004 | Schonewille | B08B 1/008 15/29 |
| 2006/0071505 | A1* | 4/2006 | Ciavaglia | E05F 15/627 296/146.11 |
| 2011/0111900 | A1* | 5/2011 | Wilson | F16C 13/006 474/166 |
| 2012/0297682 | A1* | 11/2012 | Ha | E05F 11/486 49/358 |
| 2015/0191957 | A1* | 7/2015 | Takeda | E05F 11/483 49/352 |

* cited by examiner

CABLE PULLEY FASTENER AND METHOD OF FASTENING A CABLE PULLEY FOR A WINDOW LIFTER OF A VEHICLE

CROSS REFERENCE TO RELATED APPLICATIONS

This application claims foreign priority under 35 U.S.C. § 119 to the following German Patent Application No. 10 2017 113 682.7 filed on Jun. 21, 2017, the entire contents of which are incorporated herein by reference thereto.

BACKGROUND

Various embodiments of the present invention relate to a cable pulley fastener and method of fastening a cable pulley to a window regulator of a vehicle.

In addition, embodiments of the present invention provide improvements in the formation and mounting of window regulator systems. Still further, other embodiments of the present invention provide improved mounting structures and methods for formation and attachment of window regulator systems to a vehicle body.

Actuation of windows, such as vehicle windows, often utilizes window regulator systems for controlling vertical movement of the window. In one configuration, such window regulator systems include one or more window attachments carriers or sliders each slidably engaging a guide rail. The window attachment also includes an attachment feature for attachment of the window to the window attachment and hence the window moves as the attachment slides along the guide rail. In order to facilitate the movement of the window, the window attachment is secured to a drive means, such as a cable, which is driven by a drum rotated by a motor. In operation, as the drum rotates a portion of at least one cable is wound onto the drum while a portion of the at least one cable or another cable is unwound from the drum. Each end of the cable or if two separate cables are employed one end of each of the cables are secured to the window attachment to either pull or allow for (e.g., unwind) slidable movement of the window attachment as the cable drum is rotated by the motor.

Since the cable drum is typically remotely located from the ends of the guide rail the window attachment slides along, pulleys are located near or at the distal ends of the guide rail so that as the cable drum is rotated the applicable force is applied to the window attachment in order to cause it to slide along the guide rail. The pulleys provide rotational support of the cable(s) as is/they are wound and unwound from the cable drum.

However and in view of a desire to simplify securement methods, strength of the system, and overall efficiencies, without adversely affecting performance it is desirable to provide an improved fastener for securement of the pulley to the rail as well as a window regulator with such a fastener.

Accordingly, it is desirable to provide a fastener for securement of the pulley to the guide rail. Still further, it is desirable to provide a method for securement of the fastener to the guide rail as well unique configurations thereof.

SUMMARY OF THE INVENTION

In one embodiment, a pulley stud for a window regulator is provided. The pulley stud having: an upper head portion; a shaft portion; a first mounting portion; and a second mounting portion, wherein the first mounting portion has an anti-rotation portion located on a portion of the periphery of the first mounting portion.

In addition to one or more of the features described above, or as an alternative to any of the foregoing embodiments, the first mounting portion may have a groove located on another portion of the periphery of the first mounting portion.

In addition to one or more of the features described above, or as an alternative to any of the foregoing embodiments, the second mounting portion may have has a plurality of threads configured to threadingly engage a threaded nut or threaded opening or threadingly receive a screw.

In addition to one or more of the features described above, or as an alternative to any of the foregoing embodiments, the first mounting portion may be configured to snap-fittingly engage an opening of a guide rail of the window regulator.

In addition to one or more of the features described above, or as an alternative to any of the foregoing embodiments, the anti-rotation portion is a flat surface and the first mounting portion has a groove located on another circular portion of the periphery of the first mounting portion.

In addition to one or more of the features described above, or as an alternative to any of the foregoing embodiments, the first mounting portion is configured to snap-fittingly engage an opening of a guide rail of the window regulator.

In addition to one or more of the features described above, or as an alternative to any of the foregoing embodiments, the at least a non-revolutionary wall defines a portion of the opening and the non-revolutionary wall is force mounted into engagement with the pulley stud when the second mounting portion is inserted into the opening.

In another embodiment, a window regulator is provided. The window regulator having: a guide rail; and a pulley rotationally mounted to the guide rail via a pulley stud, wherein the pulley stud is snap fittingly secured to the guide rail.

In addition to one or more of the features described above, or as an alternative to any of the foregoing embodiments, the anti-rotation portion may be configured to engage a straight edge surface of an opening in the guide rail.

In addition to one or more of the features described above, or as an alternative to any of the foregoing embodiments, the guide rail includes a single tab or a plurality of tabs configured to engage the first mounting portion when it is secured to the guide rail.

In addition to one or more of the features described above, or as an alternative to any of the foregoing embodiments, the tab or a plurality of tabs are formed out a flexible material that has resilient qualities.

In addition to one or more of the features described above, or as an alternative to any of the foregoing embodiments, the guide rail is formed from plastic.

In addition to one or more of the features described above, or as an alternative to any of the foregoing embodiments, the second mounting portion is configured to secure the guide rail to a door panel and wherein the second mounting portion extends from the guide rail when the pulley stud is secured to the guide rail.

In addition to one or more of the features described above, or as an alternative to any of the foregoing embodiments, the second mounting portion has a plurality of threads configured to threadingly engage a threaded nut.

In yet another embodiment, a method of mounting a pulley to a guide rail) of a window regulator is provided. The method including the steps of: locating the pulley on a shaft portion of a pulley stud; inserting a first mounting portion of the pulley stud into an opening of the guide rail such that the pulley stud snap fittingly engages guide rail.

In addition to one or more of the features described above, or as an alternative to any of the foregoing embodiments, the first mounting portion has an anti-rotation portion located on a portion of the periphery of the first mounting portion.

In addition to one or more of the features described above, or as an alternative to any of the foregoing embodiments, the first mounting portion has a groove located on another portion of the periphery of the first mounting portion.

In addition to one or more of the features described above, or as an alternative to any of the foregoing embodiments, the second mounting portion has a plurality of threads configured to threadingly engage a threaded nut.

In addition to one or more of the features described above, or as an alternative to any of the foregoing embodiments, the anti-rotation portion is a flat surface and the guide rail has a plurality of tabs configured to engage the first mounting portion when it is secured to the guide rail.

In addition to one or more of the features described above, or as an alternative to any of the foregoing embodiments, the guide rail is formed from plastic.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein.

Figure 1:
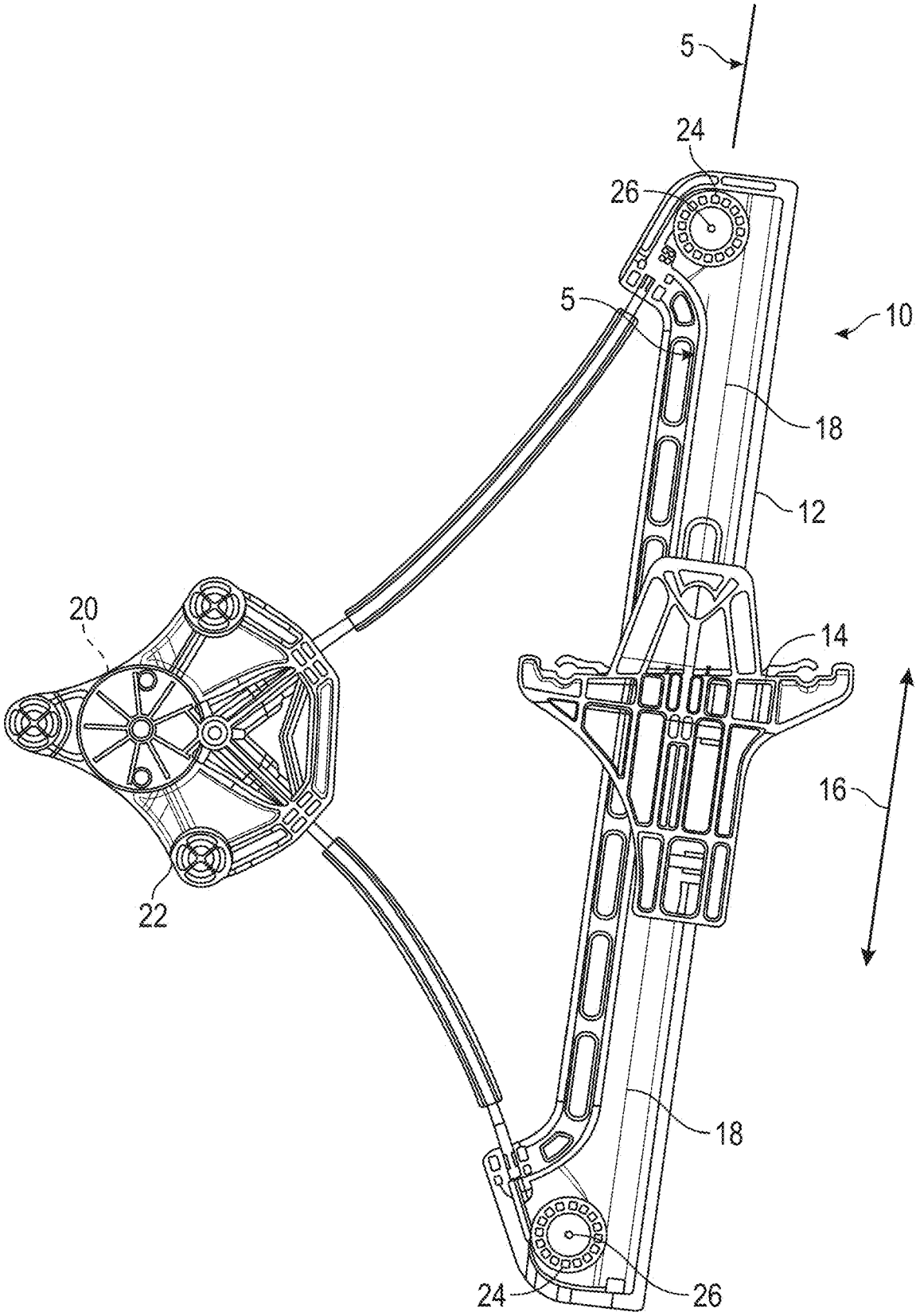
FIGS. 1 and 2 are views of a window regulator in accordance with an embodiment of the present invention.

Although the drawings represent varied embodiments and features of the present invention, the drawings are not necessarily to scale and certain features may be exaggerated in order to illustrate and explain exemplary embodiments the present invention. The exemplification set forth herein illustrates several aspects of the invention, in one form, and such exemplification is not to be construed as limiting the scope of the invention in any manner.

DETAILED DESCRIPTION

Referring now to the FIGS., a window regulator 10 is illustrated. Window regulator 10 has a guide rail 12 and a window attachment, carrier or slider 14 slidably secured to the guide rail for movement in the direction of arrows 16 is response to movement of a cable or pair of cables 18 each having one end operatively coupled to the carrier 14 at one end and a cable drum 20 (illustrated by the dashed lines in FIG. 1). The cable drum is rotationally received within a motor housing 22 and is operatively coupled to a motor (not shown) such that as the motor is energized the cable drum 20 will rotate and one cable 18 will be wound onto the cable drum 20 while the other cable is unwound from the cable drum in order to provide the desired movement of the carrier in the directions of arrows 16.

Figures 2, 2A, 3, 4:
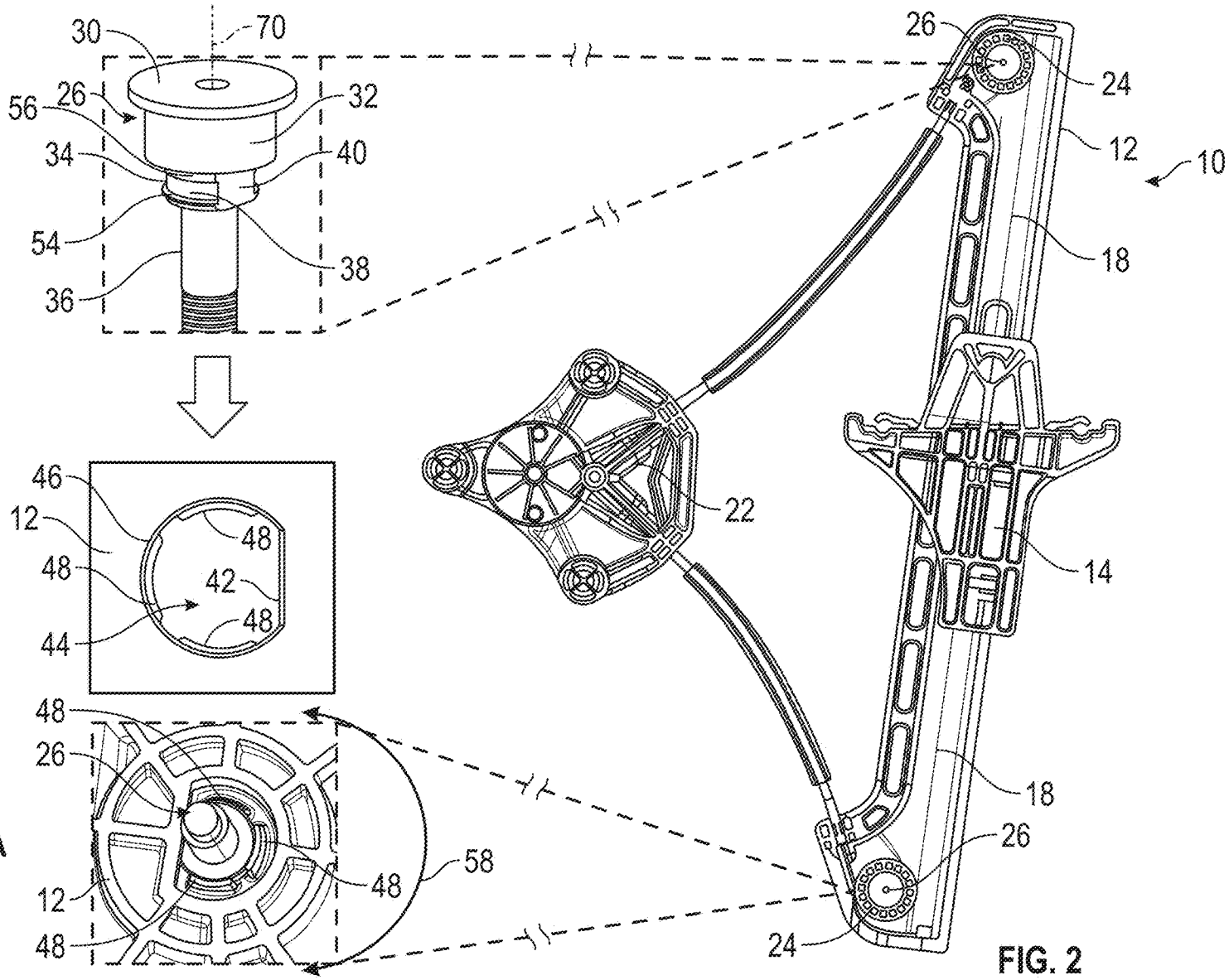
FIG. 2A is an enlarged view of a pulley stud or fastener secured to a guide rail of a window regulator in accordance with an embodiment of the present invention.
FIG. 3 is a view of a portion of a guide rail of the window regulator illustrated in FIGS. 1, 2 and 2A.
FIG. 4 is a perspective view of a pulley stud in accordance with an exemplary embodiment of the present invention.

In order to transfer the rotational movement of the cable drum 20 to the carrier 14 pulleys 24 are secured to the guide rail 12. FIGS. 1 and 2 illustrate potential locations of pulley 24 securement to guide rail 12. The pulleys 24 are mounted to the guide rail 12 via a shaft or stud 26. In accordance with one embodiment of the present invention, the pulley shaft or pulley stud 26 is also used to secure the guide rail 12 of the window regulator 10 to a portion of the vehicle for example, a portion of a door panel or door panel inner 28. In one embodiment, the pulley shaft or pulley stud 26 is formed out of metal. Although and in an alternative embodiment, the pulley shaft or pulley stud 26 may be formed from plastic.

In one embodiment, the pulley shaft or stud 26 has an upper head portion 30, a shaft portion 32, a first mounting portion or guide rail mounting portion 34 and a second or fixation or regulator mounting portion 36. In one embodiment, the first mounting portion or guide rail mounting portion 34 has a groove 38 surrounding a portion of the periphery of the first mounting portion or guide rail mounting portion 34 and an anti-rotation portion or flat portion 40 located on another portion of the periphery of the first mounting portion or guide rail mounting portion 34. In one embodiment, the anti-rotation portion 40 is a flat surface. Alternatively, the anti-rotation portion 40 may be a cured surface or any other surface that acts as an anti-rotation feature in that it prevents pulley stud or pulley shaft 26 from rotating when it is inserted into opening 44. In one non-limiting embodiment, the groove 38 and the anti-rotation portion or flat portion 40 extend about the periphery of the first mounting portion or guide rail mounting portion 34.

The anti-rotation portion or flat portion 40 may be configured to align with or rest against a corresponding flat or straight edge surface 42 of an opening 44 in the guide rail 12. The remainder of the opening has a circular or curved portion 46 that is configured to align with or engage groove 38 of pulley shaft or stud 26.

In addition, the circular or curved portion 46 of opening 44 will have a plurality of flexible tabs 48 that are configured to engage a groove or feature (e.g., protrusion or depression) 38 when it is inserted into opening 44. In an alternative embodiment, a plurality of grooves or features 38 may be located on the pulley shaft or stud 26. In one embodiment, only a single tab 48 may be configured and positioned to engage groove 38. Accordingly, one or a plurality of tabs 48 may be employed to retain pulley shaft or stud 26 in opening 44. For example and as pulley shaft or stud 26 is inserted into opening 44 in the direction of arrow 50, tabs or tab 48 will deflect outwardly in the direction of arrows 52 so that a first wall member 54 can pass by the end of the tabs 48 as the pulley shaft or stud 26 is inserted into opening 44 in the direction of arrow 50. Once this occurs, the tabs or tab 48 move back in a direction opposite to arrows 52 so that the ends of the tabs 48 are located in groove 38 between the first wall member 54 and a second wall member 56 that define groove 38.

Tabs 48 of guide rail 12 are formed out a flexible material such as plastic that has resilient qualities such that as the tabs 48 are deflected in the direction of arrows 52 a biasing force in the opposite direction is provided so that tabs 48 can spring back to the original or first position wherein a second position of the tabs 48 corresponds to movement of the ends of the tabs 48 sufficient enough to allow first wall member 54 to pass by the ends of the tabs 48 as the pulley shaft or stud 26 is inserted into opening 44 in the direction of arrow 50.

Accordingly, pulley shaft or stud 26 as well as opening 44 are configured to allow for "snap fit" or snap fitting engagement of the pulley shaft or stud 26 into opening 44. In other words, the opening 44 of the guide rail 12 is configured such that pulley shaft or stud 26 can be fixedly inserted into opening 44 simply by inserting the same in the direction of arrow 50.

In addition, the configuration of opening 44 (flat or straight edge surface 42) and the first mounting portion or guide rail mounting portion 34 (an anti-rotation portion or flat portion 40) prevent rotation of the pulley shaft or stud 26 in the direction of arrows 58 about axis 70 when the pulley shaft or stud 26 is fully inserted into opening 44 and tabs 48 engage the groove 38 of the first mounting portion or guide rail mounting portion 34. Accordingly, the pulley shaft or stud 26 is provided with an anti-rotation geometry which corresponds to opening 44 of guide rail 12. The pulley shaft or stud 26 is also provided with a snap-fit function such that as the pulley shaft or pulley stud 26 is inserted into opening 44 it is fixedly secured therein without the use of additional fasteners and is also provided with an anti-rotation feature.

In addition and as mentioned above, the pulley shaft or pulley stud 26 is also provided with a second or fixation or window regulator mounting portion 36 that extends from the first mounting portion or guide rail mounting portion 34. This second portion 36 is configured to allow for the mounting of the window regulator 10 to a door panel or door panel inner 28. In one embodiment, the second portion 36 is configured to have a plurality of threads 72 that are engaged by a threaded nut 74, which is configured to engage second portion 36 after it is inserted into an opening 76 of the door panel or door panel inner 28. It being understood that the threaded nut 74 is larger than opening 76 such that threaded nut 74 can secure the pulley shaft or pulley stud 26 to the door panel 28.

Figure 5:
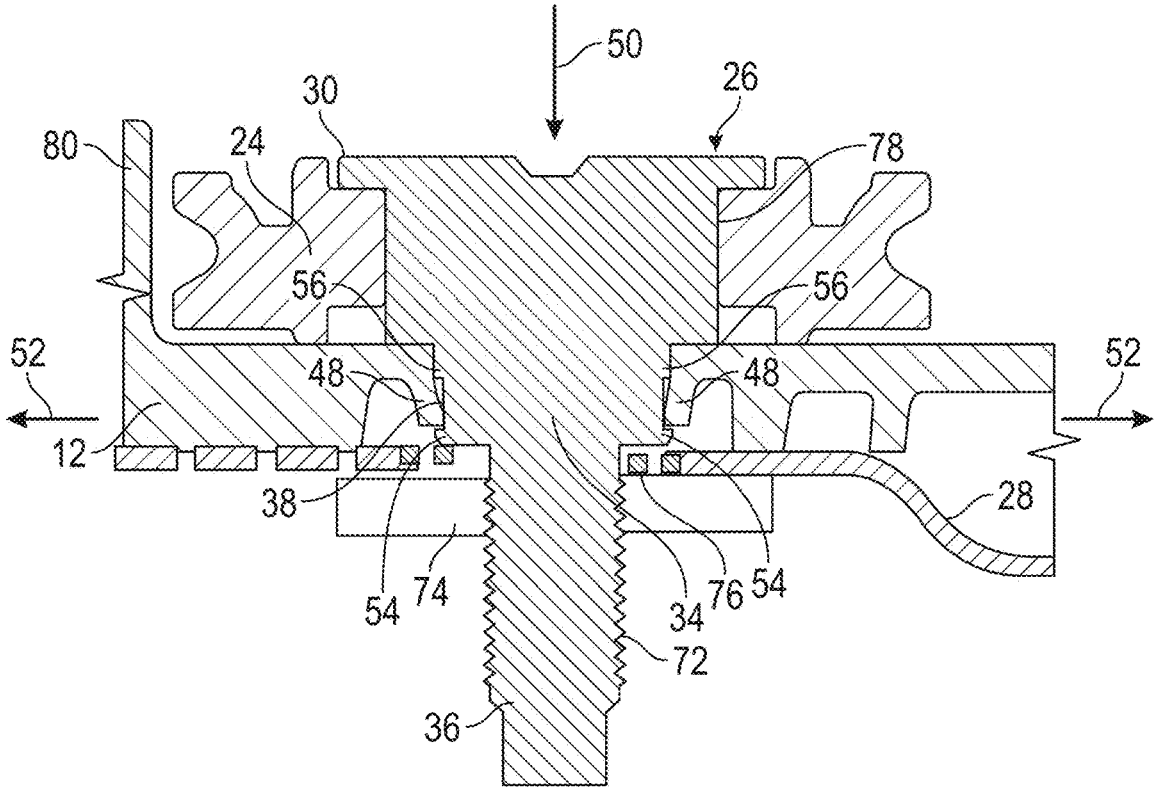
FIG. 5 is a cross-sectional view along lines 5-5 of FIG. 1.
Figure 5A:
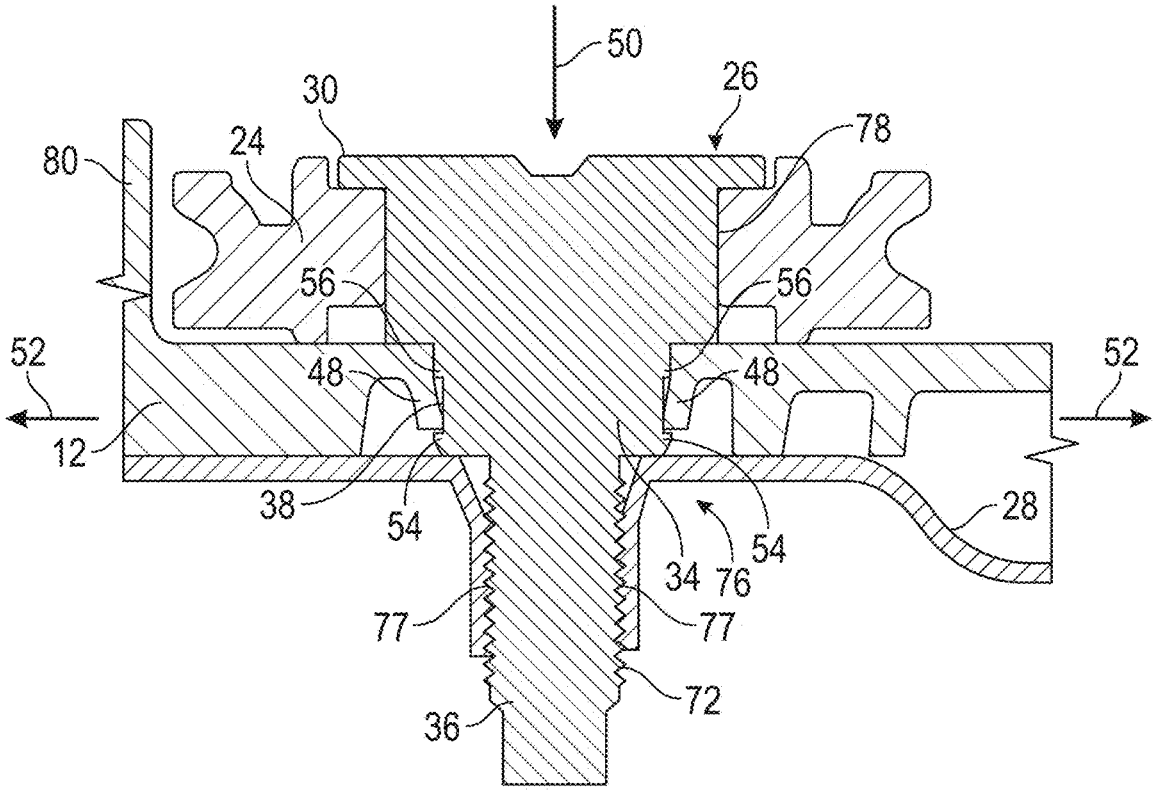
FIG. 5A is a cross-sectional view of an alternative embodiment of the present invention.
Figure 5B:
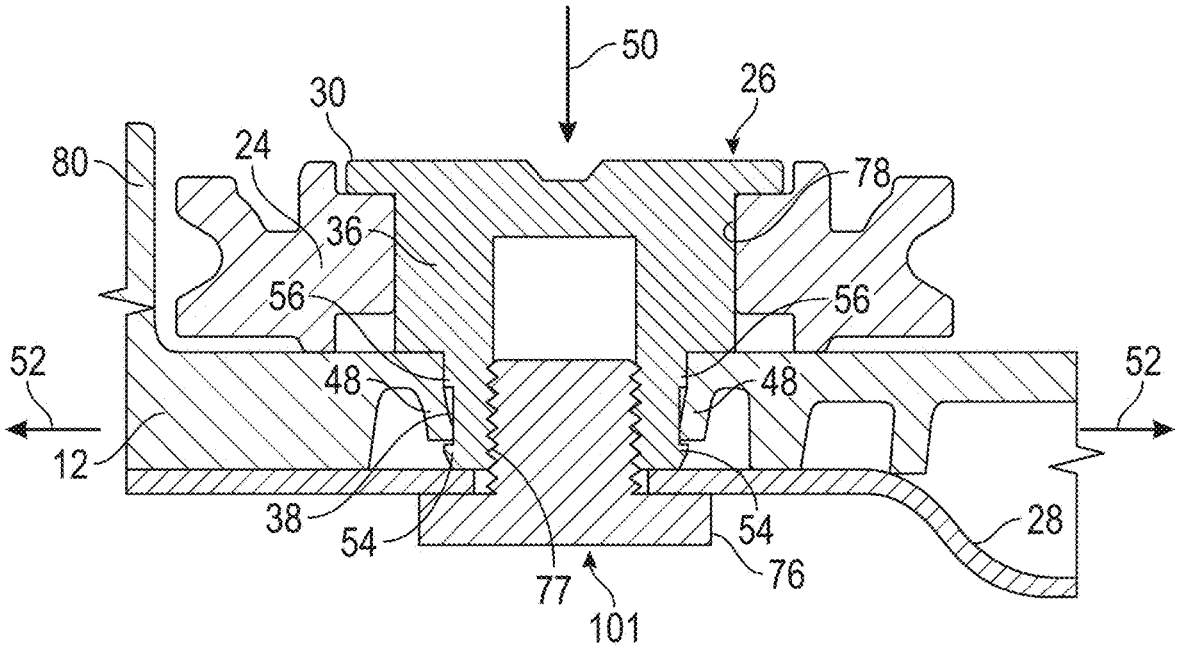
FIG. 5B is a cross-sectional view of yet another alternative embodiment of the present invention.

In an alternative embodiment and as illustrated in FIG. 5A, the threaded nut 74 may be replaced with a threaded opening 76 in the door panel inner 28 such that the plurality of threads 72 are engaged by threads 77 of threaded opening 76, which are configured to engage second portion 36 after it is rotatably inserted into threaded opening 76 of the door panel or door panel inner 28. In yet another alternative embodiment and as illustrated in FIG. 5B, second portion 36 may be configured to threadingly receive a screw 101 that would secure the pulley shaft or pulley stud 26 in opening 76 and to door panel 28.

Figure 5C:
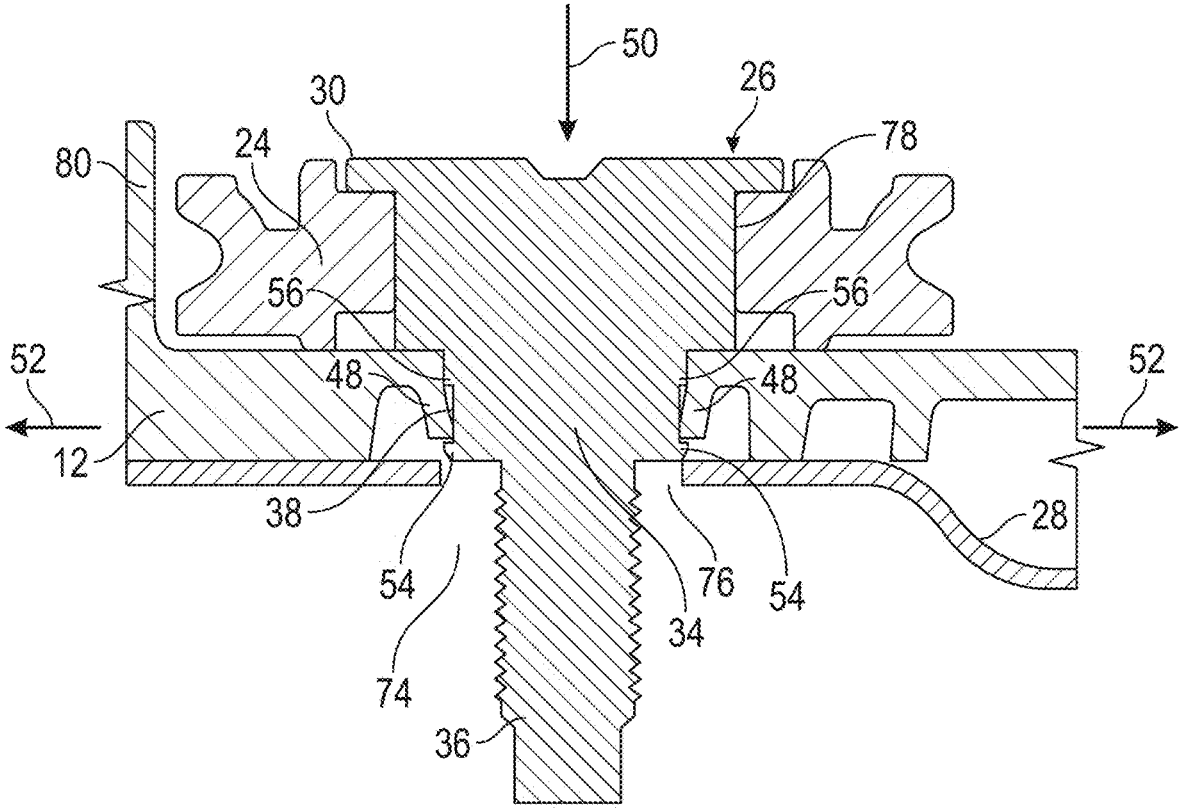
FIG. 5C is a cross-sectional view of yet another alternative embodiment of the present invention.
Figure 5D:
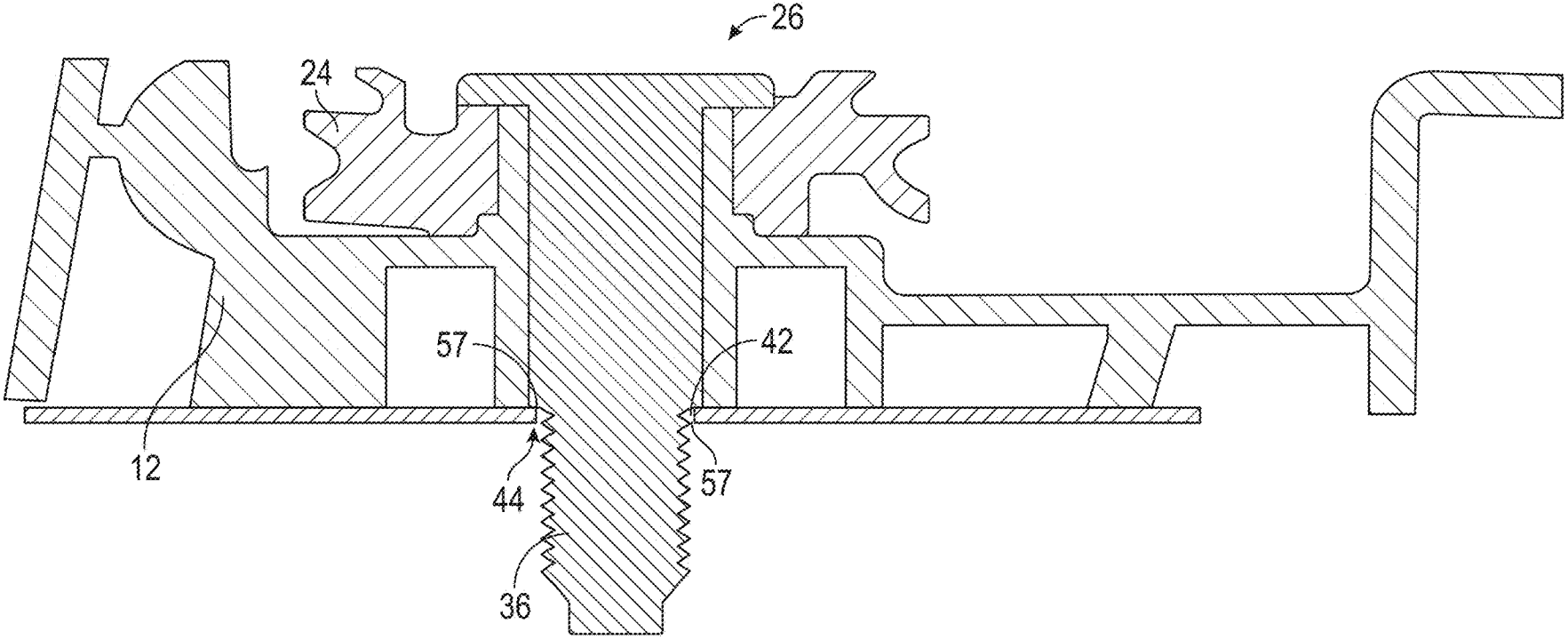
FIG. 5D is a cross-sectional of yet another alternative embodiment of the present invention.

In still yet another alternative embodiment and as illustrated in FIG. 5C, the distal end of the front mounting portion 34 may be received in opening 76 of inner panel 28. This embodiment may be used in any of the configurations or embodiments illustrated in at least FIGS. 5, 5A, 5B. In still yet another alternative embodiment and as illustrated in FIG. 5D, the function of the tabs 48 engaging groove 38 is replaced by force mounting a wall 57 of the hole or opening 44 to ensure provisory assembly, wall 57 and hole 44 have an at least partially non revolutionary shape like one or more flat portion 42 or a star shape. The final assembly of portion 36 onto door panel inner 28 definitively prevents the pulley stud 26 to disengage from guide rail 12. For ease of introduction, a radius or slightly conical shape on hole 44 can be designed at the interface with the guide rail surface facing the pulley.

As illustrated in at least FIG. 5, the upper head portion 30 of the pulley shaft or pulley stud 26 extends outwardly from shaft portion 32 such that pulley 24 is rotationally retained on shaft portion 32 between head portion 30 and a surface of guide rail 12. For example, an opening 78 of pulley 24 is located upon shaft portion 32 prior to the insertion of pulley shaft or pulley stud 26 into guide rail 12 in the direction of arrow 50.

In one embodiment, the guide rail 12 may be configured with a vertical wall portion or wall portion 80 that extends upwardly proximate to the periphery of pulley 24. In one embodiment, vertical wall portion wall portion 80 may be be configured to provide a retaining feature for cable 18 as it is passed along rotating pulley 24.

Accordingly, various embodiments of the present invention allow for the window regulator 10 and/or guide rail 12 of window regulator 10 to be secured or fixed to its desired location (e.g., vehicle door) through the use of the pulley shaft axis via a stud.

In particular, various embodiments of the present invention are directed to guide rails 12 that are formed out of plastic, composites or any other polymer and are required to be secured during their operational use. The shaft or pulley stud 26 as illustrated and described herein allows for quick insertion into the guide rail 12 without any additional tools or fasteners in a manner that secures the pulley 24 to the guide rail 12 and also provides a means for securement of the guide rail 12 to the door panel via an integral mounting portion 36, which in one embodiment may comprise a plurality of threads 72 that are engaged by a threaded nut 74 in order to secure the guide rail 12 to the door panel inner 28.

Although and in one embodiment the securement of the pulley shaft or pulley stud 26 to the guide rail 12 is achieved by insertion and snap fitting engagement with the guide rail 12 alternative embodiments contemplate insertion and rotational securement of the pulley shaft or pulley stud 26 into opening 44. In this embodiment, the mounting portion 34 and opening 44 may be configured to have a circular configuration wherein rotational movement of the pulley shaft or pulley stud 26 about axis 70 will lock or fix only shaft or pulley stud 26 into opening 44. Still further and in yet another alternative embodiment, the pulley shaft or pulley stud 26 may be integrally formed with the guide rail 12 via an insert molding or bi-injection process wherein the pulley shaft or pulley stud 26 comprises a different material and is insert molded into the guide rail 12 during its formation via a molding process.

A method of mounting pulley 24 to guide rail 12 is also provided herein. The method comprising the steps of locating pulley 24 on a shaft portion 32 of the pulley shaft or pulley stud 26 and then inserting the first mounting portion or mounting portion 34 into opening 44 such that the pulley shaft or pulley stud 26 snap fittingly engages guide rail 12 with the pulley 24 secured thereto.

Still further, a method of mounting guide rail 12 to the vehicle door panel 28 is provided. The method comprising the steps of securing the guide rail 12 to the vehicle door panel 28 via the mounting portion 36 that is integrally formed with the shaft or pulley stud 26, which rotationally secures the pulley 24 to the guide rail 12. In addition, a method of mounting the window regulator 10 to the door panel 28 is also provided. The method comprising the steps of securing the window regulator 10 to the door panel 28 via the guide rail 12 via the mounting portion 36 that is integrally formed with the shaft or pulley stud 26, which rotationally secures the pulley 24 to the guide rail 12.

Although a single window regulator 10 is illustrated various embodiments of the present invention are contemplated to systems with multiple window regulators 10. In addition and referring at least to FIG. 1, the window regulator 10 is illustrated with at least two pulleys 24 and pulley shafts or pulley studs 26. It is also understood that various embodiments cover a window regulator 10 and/or guide rail 12 with a single pulley 24 and pulley shaft or pulley stud 26 or as the case may be multiple pulleys 24 and multiple pulley shafts or pulley studs 26.

As used herein, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

The modifier "about" used in connection with a quantity is inclusive of the stated value and has the meaning dictated by the context (e.g., includes the degree of error associated with measurement of the particular quantity).

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A pulley stud for a window regulator, comprising:
an upper head portion;
a shaft portion;
a first mounting portion;
a second mounting portion, wherein the first mounting portion has an anti-rotation portion located on a portion of a periphery of the first mounting portion, and wherein the anti-rotation portion is a flat surface and the first mounting portion has a groove located on another circular portion of the periphery of the first mounting portion.

2. The pulley stud as in claim 1, wherein the second mounting portion has a plurality of threads configured to threadingly engage a threaded nut or threaded opening or threadingly receive a screw.

3. The pulley stud as in claim 1, wherein the first mounting portion is configured to snap-fittingly engage an opening of a guide rail of the window regulator.

4. A window regulator, comprising:
a guide rail; and
a pulley rotationally mounted to the guide rail via a pulley stud, wherein the pulley stud is snap fittingly secured to the guide rail, wherein the pulley stud further comprises:
an upper head portion;
a shaft portion;
a first mounting portion; and
a second mounting portion, wherein the first mounting portion has an anti-rotation portion located on a portion of a periphery of the first mounting portion.

5. The pulley stud as in claim 4, wherein the first mounting portion is configured to snap-fittingly engage an opening of a guide rail of the window regulator.

6. The window regulator as in claim 5, wherein the anti-rotation portion is configured to engage a straight edge surface of an opening in the guide rail.

7. The window regulator as in claim 6, wherein the guide rail further comprises a single tab or a plurality of tabs configured to engage the first mounting portion when the first mounting portion is secured to the guide rail.

8. The window regulator as in claim 7, wherein the single tab or the plurality of tabs are formed out a flexible material that has resilient qualities.

9. The window regulator as in claim 5, wherein the guide rail is formed from plastic.

10. The window regulator as in claim 5, wherein the second mounting portion is configured to secure the guide rail to a door panel and wherein the second mounting portion extends from the guide rail when the pulley stud is secured to the guide rail.

11. The window regulator as in claim 5, wherein the second mounting portion has a plurality of threads configured to threadingly engage a threaded nut.

12. The window regulator as in claim 11, wherein at least a non-revolutionary wall defines a portion of an opening and the non-revolutionary wall is force mounted into engagement with the pulley stud when the first mounting portion is inserted into the opening.

13. A method of mounting a pulley to a guide rail of a window regulator, comprising:
locating the pulley on a shaft portion of a pulley stud;
inserting a first mounting portion of the pulley stud into an opening of the guide rail such that the pulley stud snap fittingly engages the guide rail, wherein the first mounting portion has an anti-rotation portion located on a portion of a periphery of the first mounting portion.

14. The method as in claim 13, wherein the guide rail is formed from plastic.

15. The method as in claim 13, wherein the first mounting portion has a groove located on another portion of the periphery of the first mounting portion.

16. The method as in claim 13, wherein the pulley stud has a second mounting portion that has a plurality of threads configured to threadingly engage a threaded nut.

17. The method as in claim 13, wherein the anti-rotation portion is a flat surface and the guide rail has a plurality of tabs configured to engage the first mounting portion when the first mounting portion is secured to the guide rail.

* * * * *